US008743664B2

(12) United States Patent
Mintiens

(10) Patent No.: US 8,743,664 B2
(45) Date of Patent: Jun. 3, 2014

(54) DIAL MODULE FOR A WATCH, AND WATCH INCLUDING SUCH A DIAL MODULE

(76) Inventor: Benoit Mintiens, Lint (BE)

( * ) Notice: Subject to any disclaimer, the term of this patent is extended or adjusted under 35 U.S.C. 154(b) by 15 days.

(21) Appl. No.: 13/515,055

(22) PCT Filed: Dec. 10, 2010

(86) PCT No.: PCT/BE2010/000082

§ 371 (c)(1),
(2), (4) Date: Jun. 11, 2012

(87) PCT Pub. No.: WO2011/069218

PCT Pub. Date: Jun. 16, 2011

(65) Prior Publication Data

US 2012/0287762 A1 Nov. 15, 2012

(30) Foreign Application Priority Data

Dec. 11, 2009 (BE) ..... 2009/0789

(51) Int. Cl.
*G04B 19/06* (2006.01)

(52) U.S. Cl.
USPC ..... 368/238; 368/232; 368/76

(58) Field of Classification Search
USPC ..... 368/232–233, 76–78, 238–239, 228
See application file for complete search history.

(56) References Cited

U.S. PATENT DOCUMENTS

| | | | | | |
|---|---|---|---|---|---|
| 4,956,828 | A | * | 9/1990 | Yamada | 368/76 |
| 5,103,434 | A | * | 4/1992 | Sullivan | 368/238 |
| 5,349,572 | A | * | 9/1994 | Belik | 368/77 |
| 5,359,578 | A | * | 10/1994 | Truini | 368/76 |

FOREIGN PATENT DOCUMENTS

| | | | |
|---|---|---|---|
| CH | 676 074 | A3 | 12/1990 |
| EP | 0 389 290 | A2 | 9/1990 |
| EP | 0 921 451 | A1 | 6/1999 |
| EP | 1 003 085 | A1 | 5/2000 |

OTHER PUBLICATIONS

International Search Report, dated May 9, 2011, from corresponding PCT application.

* cited by examiner

*Primary Examiner* — Sean Kayes
(74) *Attorney, Agent, or Firm* — Young & Thompson

(57) ABSTRACT

Dial module for a clock provided with several pointers whose shafts can be driven by the clock mechanism, characterized in that the dial module (1) consists of a casing (10), at least two separate pointers, whereby each pointer (2,3) is provided with its own separate concentric dial (6,7), and whereby at least a pointer (3), together with its shaft (5) and dial (7), can move with respect to another first pointer (3), such that the two pointers (2,3) never overlap one another, and that the mobile dial(s) (7) always maintain a fixed orientation with respect to the casing (10), whereby the upper visible part of the pointers (2,3) and the dials (6,7) are arranged on a single continuous surface.

17 Claims, 6 Drawing Sheets

DIAL MODULE FOR A WATCH, AND WATCH INCLUDING SUCH A DIAL MODULE

BACKGROUND OF THE INVENTION

1. Field of the Invention

The present invention relates to a dial module for a clock, more specifically a dial module provided with several pointers that move on and relative to a timescale on a dial and which are driven by the clock mechanism.

2. Description of the Related Art

Among the mechanical clocks or clocks with an analogue readout, two major categories can be distinguished between.

A first category, the best known, is that of the traditional clock provided with a dial and pointers in the form of hands that turn around an axis under the effect of the clock mechanism.

A second category, less known, is that of the clock equipped with rotating rings or disks provided with an inscription. The disks or rings are placed directly on the drive shafts of the clock mechanism, and they replace the pointers. On the rings are the figures that correspond to the time function of the ring, i.e. the figures 1 to 12 for an hours ring, 1 to 60 for a minutes ring and a seconds ring. A reference or frame affixed on the clock indicates the reading markers or lines, with the figures being on the outermost fixed ring.

The first category of traditional clocks with pointer and dial presents the advantage of being able to rely, in collective thought, on a practically archetypical reading reflex. Our cognitive processes are such that a quick glance is sufficient to know the time, without having to read in detail the figures at which the pointers are pointing.

A disadvantage of this category is that it mechanically implies that the time indication is structured in layers, with each pointer being in a different plane in order to avoid intersections between the pointers.

This means that the pointers cover one another in certain positions, or that other information such as information relating to the date can be covered.

Likewise when the clock is equipped with additional functions, such as a chronometer, a 24-hour indication, the phase of the moon, an indication of the operating reserve and other indications of this type, these functions are inevitably temporarily covered, entirely or partially, which impedes or even prevents their reading in such a situation.

An example of a clock with pointers and dials, that is structured in layers, is described in the document EP 0921 451.

Another disadvantage of such a structure in layers is that because of this, a parallax error occurs when reading the time, such that a different time is read according to the visual angle from which the time is read. The time read is thus only correct when the time is read from a visual direction perpendicular to the dial.

The second category, less well known, presents the advantage that the rings or disks do not cover one another, at least when they are arranged in the same plane.

However, the intrinsic disadvantages of this category are that the user, when he wants to read the time, is required to attentively read the figures in order to know what time it is. To this is added the fact that, because of the geometric structure in rings, the figures are of a limited size. The poor reading ergonomics of this category constitutes an important reason for its low market share.

An example of a clock with disks is described in the document CH 676074. A disadvantage of this clock is that the time cannot be read in a known intuitive way and that a prior explanation is required to know how to use the clock. In addition, this clock presents the aforementioned disadvantages linked to the fact that the pointers and the dials are not in the same plane.

An example of a clock with disks and rings is described in the document EP 1 003 085. In addition to the disadvantages of being difficult to read, such a clock, as described in the document EP 1 003 085, presents the disadvantage of having a relatively substantial diameter given that a free space is required between the pointers and the dials, because of the eccentric rotation of the pointers on the dials. The pointers and the dials are thus not on a continuous surface. Dirt and dust can accumulate in the aforementioned free space between the pointers and the dials, and can disturb the good operation of the clock.

BRIEF SUMMARY OF THE INVENTION

The purpose of the present invention is to provide a solution to at least one of the aforementioned disadvantages or another disadvantage.

To this end the invention concerns a dial module for a clock. More specifically, a dial module provided with several pointers that can turn around an axis relative to a timescale on a dial arranged concentrically, whereby the shafts of the pointers can be driven by the clock mechanism characterised in that the dial module consists of a casing, at least two separate pointers, respectively a first and second pointer whose axes are arranged at a radial distance from one another, whereby each pointer is provided with its own separate concentric dial, and whereby at least the second pointer, together with its shaft and dial, can move with respect to the other second pointer such that the two pointers never overlap one another, and that the mobile dials always maintain a fixed orientation with respect to the casing, whereby the upper visible part of the pointers and the dials are arranged on a single continuous surface.

An advantage of such a dial module is that the pointers never overlap one another and that, consequently, unimpeded reading of the time and other information is possible at all times and in all circumstances.

According to a preferred characteristic, the second pointer is arranged with its dial inside the turning circle of the first pointer, such that the dial module can be made compact, which is definitely necessary for wristwatches and clocks, while nevertheless enabling a long pointer.

A practical embodiment is characterised by the fact that the first pointer is realised as a pointer symbol on a disk that can turn within an annular dial and that the dial of the second pointer is housed, so as to be able to turn, in a bearing of this disk, whereby the aforementioned disk of the first pointer and the dial of the second pointer, which is housed in a bearing, are driven by the clock mechanism at the same speed of rotation, nevertheless in opposite directions, such that during rotation the dial of the second pointer always maintains the same fixed position with respect to the casing.

Because in this embodiment the second pointer moves with its dial synchronously with the first pointer, interference or overlaps can never arise between the two pointers.

In addition, this embodiment can be realised in a relatively simple way by means of gears.

In this embodiment the dial of the second pointer may be realised as a ring housed in a bearing of the disk of the first pointer, and the second pointer may be realised as a pointer symbol on a disk housed, so as to be able to turn, in a bearing of the second aforementioned annular dial, or conversely.

In this way the upper visible part of the dial module may be realised completely flat or according to a continuous curved surface, whereby the pointers and the dials are arranged along a single continuous surface or on the face of the curved surface.

The dial module can be realised as a module that can be grafted on or integrated in the mechanism of a traditional clock, with one or more primary central drive shafts and/or one or more secondary drive shafts mounted eccentrically with respect to the aforementioned primary shafts, whereby, to this end, the dials and pointers can be driven by means of one or more gears for example.

This presents the advantage of being able to utilise existing clock mechanisms, although it does not exclude the gearwheel drive from being integrated into a clock mechanism developed to this end.

The invention also concerns a clock that contains a dial module according to the invention.

BRIEF DESCRIPTION OF THE DRAWINGS

With the intention of better showing the characteristics of the invention, a few preferred embodiments of a dial module according to the invention are described hereinafter by way of an example, without any limiting nature, with reference to the accompanying drawings, wherein:

FIG. 3 shows a view as that of FIG. 1, but where the visible part of FIG. 1 is partly transparent to show the underlying structure;

DETAILED DESCRIPTION OF THE PREFERRED EMBODIMENTS

Figure 1:
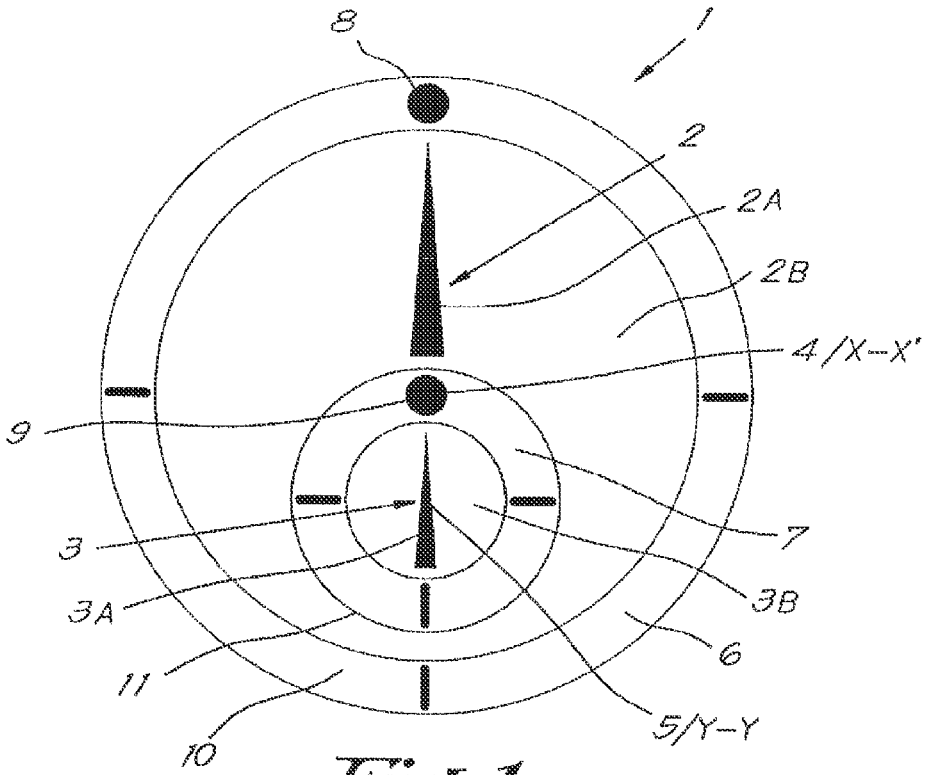
FIG. 1 schematically shows a plan view of a dial module according to the invention.

FIG. 1 illustrates an example dial module 1 according to the invention intended for a clock, with two pointers in this case, for example a first pointer 2 that represents the minutes, and a second pointer 3 that represents the hours.

These pointers 2 and 3 are each mounted separately on a shaft around which they can turn, respectively shafts 4 and 5, which are arranged at a radial distance from one another and can each turn separately with respect to its own dial, respectively 6 and 7, which is arranged concentrically around the shaft 4-5 of the pointer concerned 2-3, and which is provided with an appropriate timescale or another indication, for example a timescale 8 for the hours and a timescale 9 for the minutes.

In the example shown, the dial 6 of the first pointer 2 is a fixed dial, which forms part of the casing 10 of the dial module 1 or the clock, and which is realised as an outer ring that is coaxial with the shaft 4.

Moreover, the first pointer 2 is realised as a pointer symbol 2A on a disk 2B that can turn coaxially inside the aforementioned annular dial 6 around an axis X-X', which passes through the aforementioned shaft 4.

The dial 7 of the second pointer 3 is housed, so as to be able to turn, in a bearing located in a round opening 11 in the disk 2B of the first pointer 2 and it can turn around an axis Y-Y', which synchronously follows the rotational movement of the disk 2B around the axis X-X'.

The axis Y-Y' is also placed, for example, on the indicator axis of the first pointer 2, which in the example extends in the longitudinal direction of the pointer symbol 2B, although this is not strictly necessary.

The dial 7 of the second pointer is also realised as a ring, while the second pointer 3 is also realised as a pointer symbol 3A on a second disk 3B, which is housed, so as to be able to turn, in a bearing situated in the second aforementioned annular dial 7.

The pointers 2 and 3 and the dial 7 are driven by the clock mechanism, with the dial 7 of the second pointer 3 being driven around its axis Y-Y' at a speed of rotation equal to that of the first pointer 2, but in the opposite direction, so that the dial 7 of the second pointer 3 always maintains the same fixed orientation with respect to the casing 10 during the rotation.

Because of this, the timescale 9 always maintains a fixed orientation, as in a traditional clock where the dial 6 is fixed to the casing and thus also maintains a fixed orientation with respect to this casing 10.

The pointers 2 and 3 are driven by the clock mechanism in order to indicate, as in a traditional clock, in a known way, the hours and minutes or other information with respect to a timescale.

Figure 2:
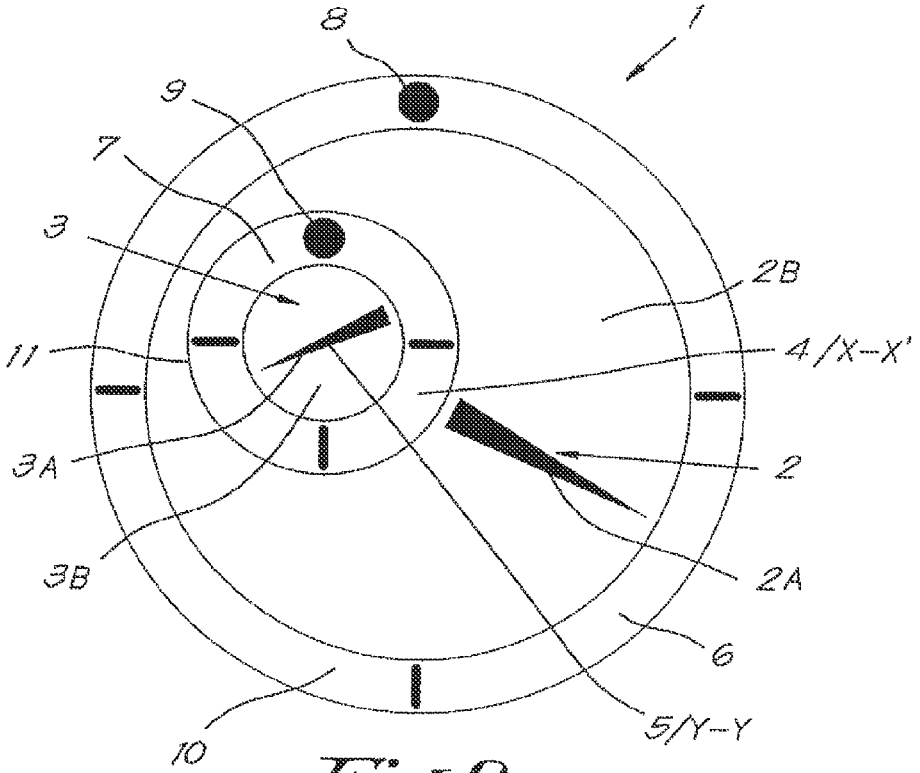
FIG. 2 shows the dial module of FIG. 1 at another time.

In FIG. 1, the dial module is shown at twelve o'clock, while in FIG. 2, the dial is shown at a later time corresponding to around twenty minutes past eight o'clock, where it is important to note that the shaft 5 of the hours hand 3 and its dial 7 have turned synchronously with the minutes hand 2 around the axis X-X'. However, with this dial 7 of the hours hand 3 always maintaining the same orientation.

The operation is thus based on an indication of the time with the pointers 2 and 3, which turn like the pointers of a traditional clock. The pointers 2 and 3 refer to a dial 6 and 7, which is not driven by a relative rotational movement. This enables it to be read "unconsciously" as is the case with traditional clocks. This means that the cognitive reading by an ordinary user enables him to deduce the time from the angular position of the pointers, without having to read which figure or symbol of the timescale 8 or 9 the pointers 2 and 3 are oriented towards.

In addition, any figures or other indications maintain a fixed orientation, so they always remain readable without having to be read upside down or sideways.

The dial module 1 is driven by means of a gearing 12, which in turn is driven by the primary shaft and/or the secondary drive shafts of the clock mechanism, which for simplicity is not shown in the drawings.

Figure 5:
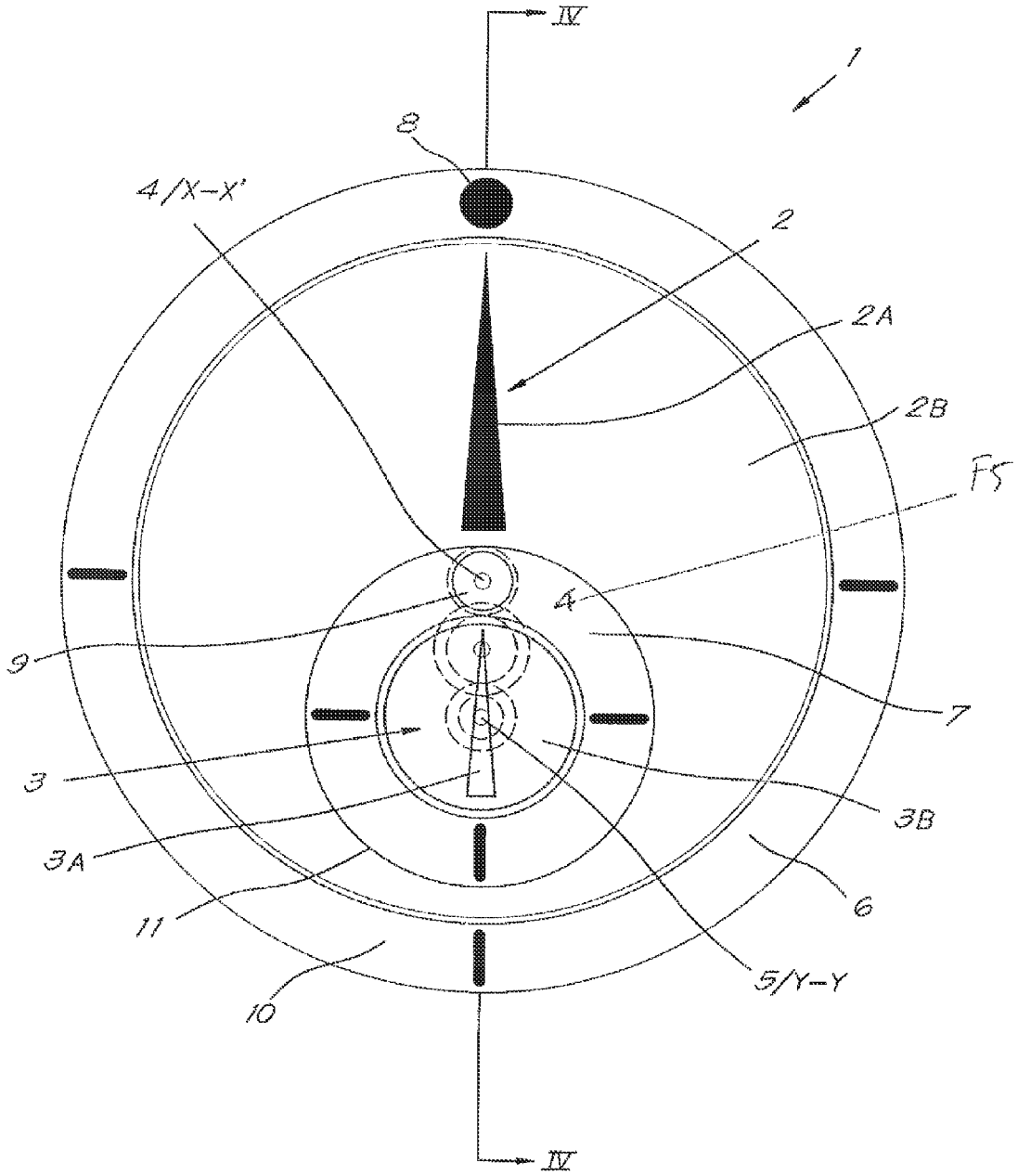
FIG. 5 shows a perspective view of the gearing indicated by F5 in FIG. 3.
Figure 4:
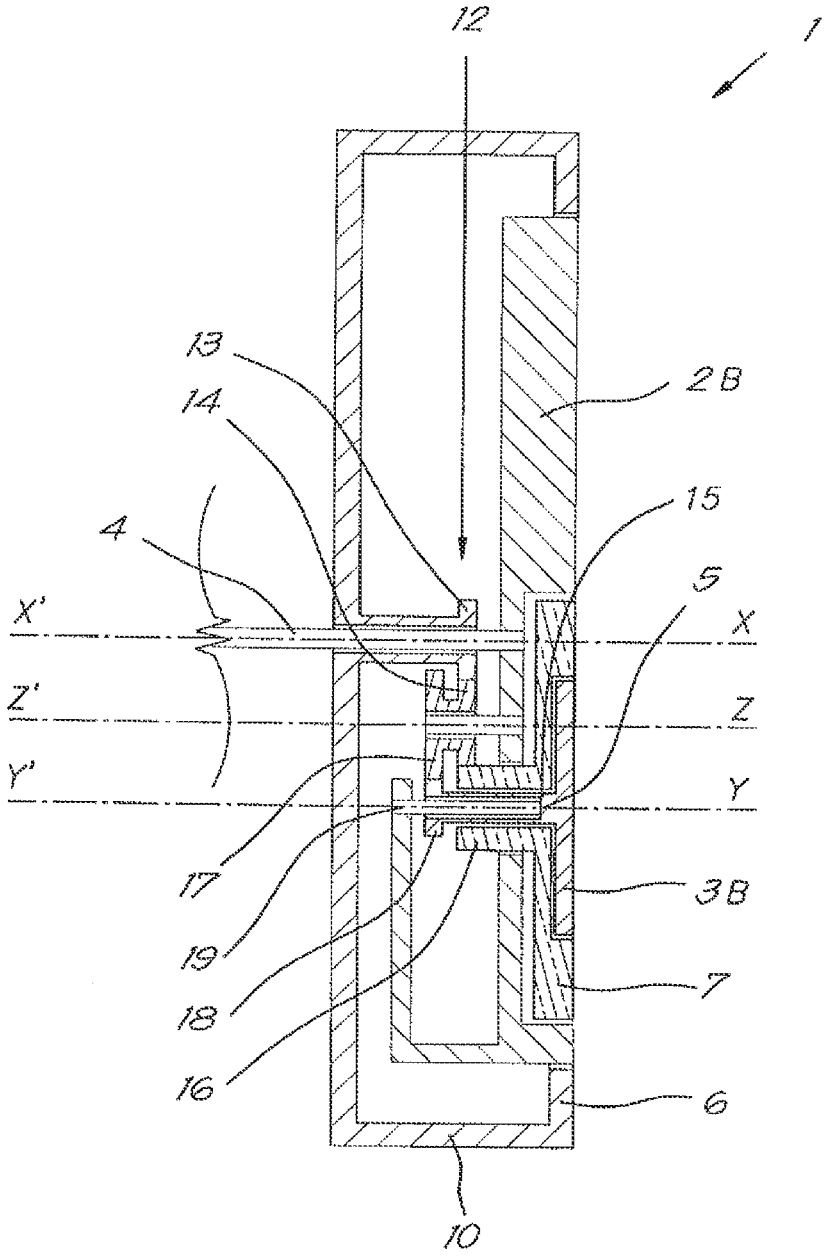
FIG. 4 shows a cross-section according to the line IV-IV of FIG. 3.
Figure 5:
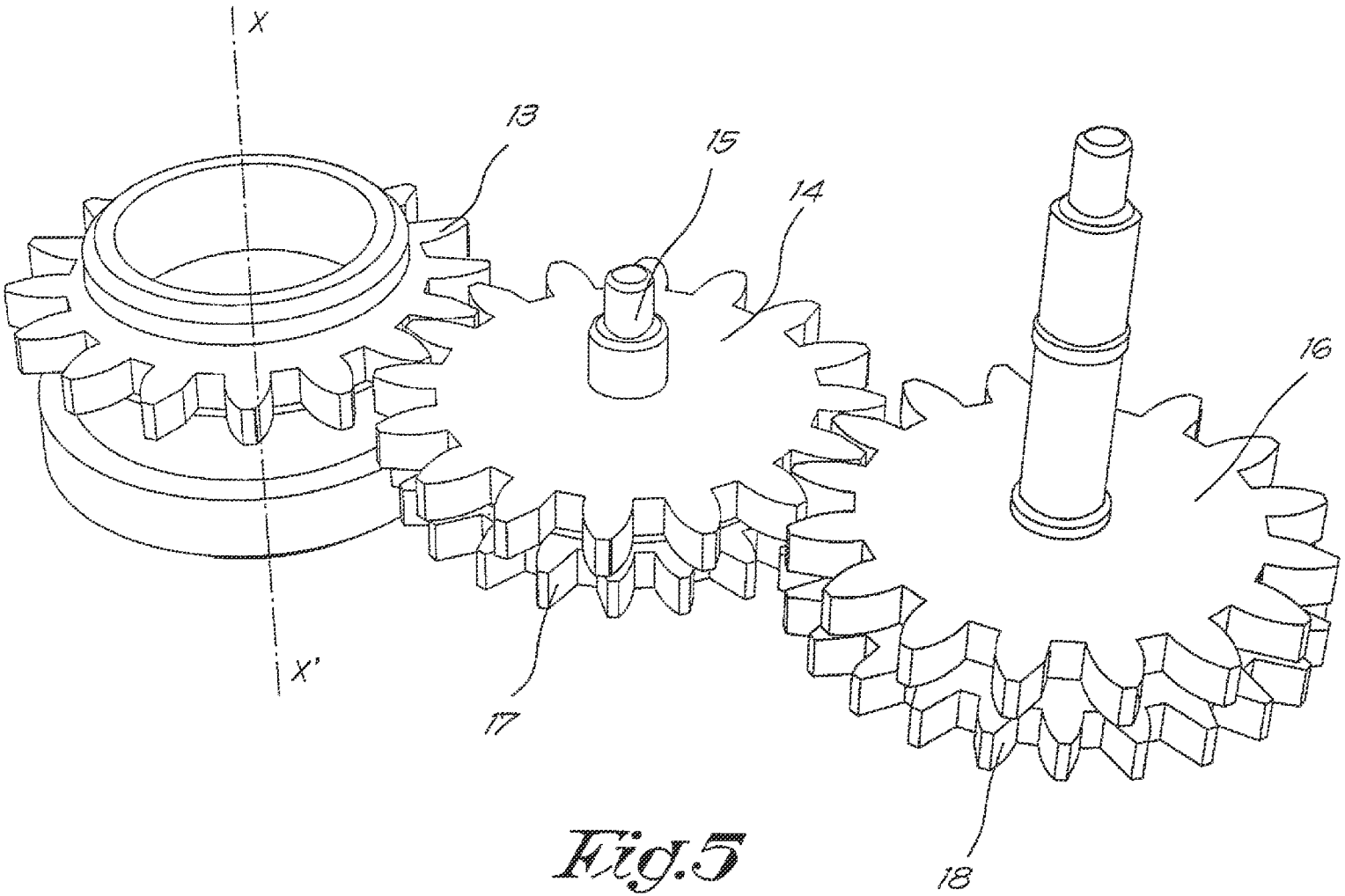

FIGS. 3 to 5 show an example of such a gearing that can be grafted onto the mechanism of a traditional clock with a central drive shaft that drives the disk 2B of the first pointer 2 via the aforementioned shaft 4.

The gearing mechanism 12 consists of a central fixed gearwheel 13, which is affixed to the casing 10 and whose axial line coincides with the axial line X-X'. The gearwheel 13 meshes with a gearwheel 14 that can freely turn around a shaft 15 on the axial line Z-Z' which is affixed to the disk 2B of the pointer 2.

This last gearwheel 14 again meshes with a gearwheel 16 that is mounted coaxially on the annular dial 7 of the second pointer 3 and which drives this dial 7.

On the aforementioned gearwheel 14 a coaxial gearwheel 17 is affixed, which meshes with a gearwheel 18 that is affixed to the disk 3B of the second pointer 3, and whose shaft coincides with the axial line Y-Y'.

This gearwheel 18 is housed in a bearing located on a shaft 19, which is affixed to the disk 2B of the first pointer 2.

The operation is simple and as follows.

When the clock mechanism drives the disk 2B of the first pointer 2 in the clockwise direction, because the gearwheel 13 is fixed, the gearwheel 14 will turn around its shaft 15 and this gearwheel 14 will in turn make the annular dial 7 of the second pointer 3 turn with respect to the disk 2B, in the anticlockwise direction however.

If the number of teeth in the gearwheels 13 and 16 is the same, the dial 7 of the second pointer 3 will always maintain the same orientation with respect to the casing 10.

The second pointer 3 is driven by the rotation of the gearwheel 17, which turns synchronously with the gearwheel 14 and which drives the gearwheel 18 of the disk 3B of the second pointer 3.

If the ratio between the number of teeth of the gearwheels 17 and 18 is chosen appropriately, the second pointer 3 will turn inside its dial 7 like a pointer of a traditional clock.

In this case it is called indirect transmission.

It is clear from the drawings that the upper visible part of the pointers and the dial is arranged on a single continuous surface and that there is thus no mutual overlap of the pointers and dials, such that the time can be clearly read from all visual angles, without any overlap of the pointers and without any parallax. Parallax that inevitably occurs when the pointers and dials are not arranged in the same plane, and which gives rise to reading differences depending on the visual angle from which the time on the clock is read.

Because the pointers and dials are on the same continuous surface, the correct time can always be read from any visual angle.

The continuous surface is a practically closed surface, so to speak. At least, there is miniscule clearance between the pointers and the dials. The clock is thus also practically hermetic to dust and can easily be made completely hermetic to dust by fitting joints between the mobile pointers and dials.

In this way, protective glass in front of the pointers and dials can even be omitted, which enables an even flatter clock to be realised.

It is not excluded that the pointers and dials are not arranged in a plane, but rather with the same advantages on a concave or convex surface and curved in a continuous way, where the axes X-X', Y-Y' and Z-Z' do not necessarily have to be parallel to one another.

It is also clear, for example, that the provision of a third pointer is not excluded, such as a seconds hand or another pointer, which can then for example be integrated into the disk 2B or 3B of the first or second pointer 2 and 3, and this for example analogous to that of the second pointer 2 and its dial 7, in the embodiment described above, is integrated in the disk 2B of the first pointer 2.

It is clear that the dial module, in the example of FIGS. 3 to 5, is only driven by a single drive shaft 4. This enables the clock mechanism used for the drive to be made simpler and more compact.

It is also clear that the dial module itself is only driven by a limited number of gears. The gears, in the example shown, consist of only two levels of gearwheels, which enables a height-compact dial module to be realised compared to the known dial modules, in which at least three levels of gearwheels are used.

As a variant to an indirect drive, as described above, a direct drive is also possible, where for driving the pointers and dials, two or more primary central drive shafts of a traditional clock are used, and consequently the gearing 12 is reduced into elements, each of which is driven by a separate drive shaft of the clock mechanism.

Figure 6:
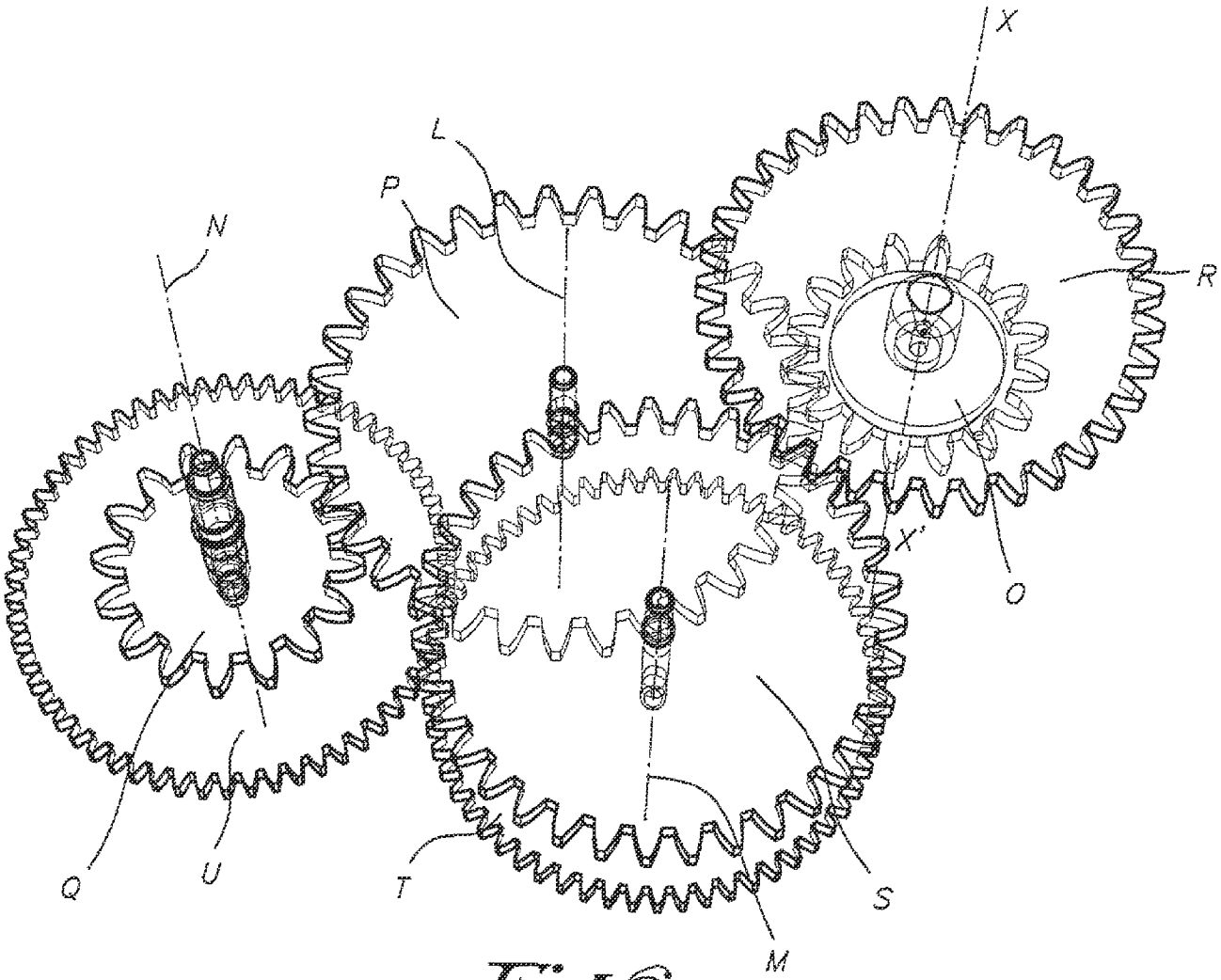
FIGS. 6 and 7 show two variants of embodiments of a gearing, as shown in FIG. 5.

An example of such a direct drive is shown in FIG. 6 where two primary drive shafts of the clock mechanism are used.

The gearwheel R is fitted directly onto the first of the central primary shafts instead of a pointer, for example on a central drive shaft for the seconds.

The gearwheel O is fixed and has a function similar to that of the gearwheel 13 in the indirect drive described above.

The axial lines L, M and N turn around X-X'. The bearings L, M and N are fixed to the disk 2B of the first pointer 2, whose axial line is X-X'. The disk 2B is mounted directly on the second primary drive shaft of the clock mechanism or is driven by a secondary shaft.

The gearwheels O, P and Q are interdependent with respect to one another. This means that when O has as many teeth as Q, during a translation of L and N around X-X', the relative angular displacement of Q with respect to O will be zero. Q is directly interdependent with the annular dial 7, via a common shaft that turns around the axial line N. This means that the annular dial 7 maintains a fixed orientation with respect to the casing 10 during a translation of N around A, if O and Q have the same number of teeth and are interdependent with respect to one another via P.

The rotation of the first pointer 2 around the shaft N will be initiated by R via S and T. The gearwheels S and T are fixed interdependently with respect one another via a shaft that turns around M, or are integrated into a single gearwheel S-T. The ratio between the gearwheels U and T or S and T must be such that the relative angular displacement between R and U is zero. If the gearwheel R has as many teeth as the gearwheel U, and if the gearwheel S has a 60/59 ratio with respect to T, a translation of M and N around X-X' will produce a zero relative angular displacement between R and U. Because of this the angular displacement of R will be equal to that of U.

In addition the direct and indirect drives via the primary central shafts of the mechanism of a traditional clock, a drive is also possible via one or more secondary drive shafts of a traditional clock mounted eccentrically, whereby these secondary shafts, in a traditional clock, are used for example for a small seconds hand mounted eccentrically, as is often used when the clock is equipped with a chronometer function, or used for other functions such as to indicate the day, phase of the moon, the operating reserve and other indications of this type.

Figure 7:
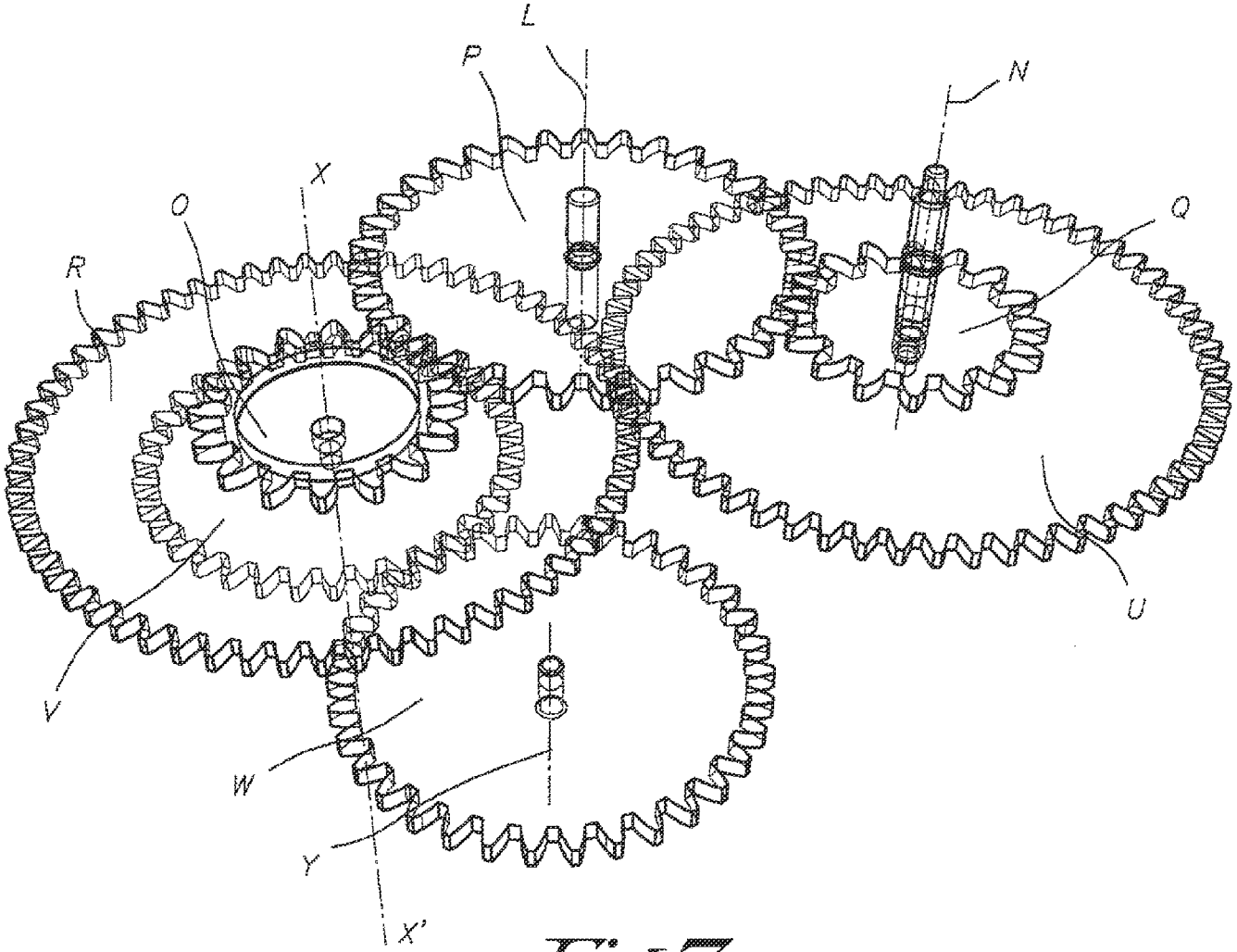

An example of such a drive is shown in FIG. 7, which is a variant of a direct drive via a secondary shaft.

This variant is formed by a gearing located between the fixed clock and the disk 2B of the first pointer 2, by means of a combination of gearwheels W, R, V and U.

The gearwheel R is affixed interdependently with V, and V and R can freely turn together around their axis X-X'. V in turn is coupled to the gearwheel W, which is affixed on a secondary shaft Y of the clock mechanism. W replaces the function, which on the traditional clock, is driven by the shaft concerned. In this way, the angular displacement is transmitted from W to U via R and V. The mutual ratios between the number of teeth of R and U must take up the rotation of N around A.

Thanks to the three gears described above, virtually all traditional clocks can be used as a basis for driving a dial module 1 according to the invention.

In the foregoing it is clear that the roles of the pointer and the dial can be reversed and that, for example, the timescale 9 is applied to the disk 2B whose orientation with respect to the casing is maintained by appropriate gearing, while the pointer function is assured by a pointer indication on the ring 7, which is driven by the clock mechanism to indicate the hour, for example.

It is not excluded either that several concentric rings are deployed, the one around the other, or around a disk, where for example the orientation of a median ring is maintained with respect to the casing and where other rings or disks each have a separate pointer function with a pointer oriented towards the median ring.

It is clear that the timescale must be interpreted widely, and that it also means, for example, an indication of the phases of the moon, the operating reserve or other information.

The present invention is by no means limited to the embodiments described as an example and shown in the drawings, but a dial module according to the invention and a clock equipped with such a module can be realised in all kinds of variants, without departing from the scope of the invention.

The invention claimed is:

1. A dial module for a clock, the dial module comprising:

a casing;

at least two separate mobile pointers, including a first pointer and second pointer having respective shafts arranged at a radial distance from one another, each of the pointers being provided with a separate concentric mobile dial, at least the second pointer together with the shaft and the dial thereof can move with respect to the first pointer such the two pointers never overlap one another and the mobile dials always maintain a fixed orientation with respect to the casing, an upper visible part of each of the pointers and each of the dials being arranged in a single continuous surface, wherein the pointers are configured to turn around an axis relative to an indication scale on the respective dial that is arranged concentrically, the shafts of the pointers being driven by a clock mechanism.

2. The dial module according to claim 1, wherein the single continuous surface is a plane or a curved surface.

3. The dial module according to claim 2, wherein the second pointer is arranged with the dial of the second pointer inside a turning circle of the first pointer.

4. The dial module according to claim 1, wherein the second pointer is arranged with the dial thereof inside a turning circle of the first pointer.

5. The dial module according to claim 1, wherein the second pointer moves with the dial thereof synchronously with the first pointer.

6. The dial module according to claim 1, wherein the first pointer comprises a pointer symbol on a first disk that can turn within the annular dial of the first pointer the dial of the second pointer being configured to turn in an opening in the first disk the first disk of the first pointer and the dial of the second pointer that is housed in a bearing, are driven by the clock mechanism at a same speed of rotation, but in opposite directions, such that the dial of the second pointer always maintains a same fixed position with respect to the casing during rotation of the dial of the second pointer.

7. The dial module according to claim 6, wherein the second dial comprises a ring housed in a bearing of the first disk of the first pointer ,and the second pointer comprises a pointer symbol on a second disk which is housed, so as to be able to turn, in a bearing of the second annular dial.

8. The dial module according to claim 1, wherein the clock mechanism is a traditional clock mechanism with one or more primary central drive shafts and/or one or more secondary drive shafts that are mounted eccentrically with respect to the primary shafts.

9. The dial module according to claim 8, wherein the mobile dials and the pointers are driven by the one or more primary shafts of the clock mechanism, each shaft driving all or some of the pointers and/or all or some of the dials.

10. The dial module according to claim 9, wherein all of the mobile pointers and the mobile dials are driven by a single shaft of the clock mechanism.

11. The dial module according to claim 10, wherein the mobile pointers and the mobile dials are driven by the one or more primary shafts in combination with or independently of one or more secondary shafts of the clock mechanism.

12. The dial module according to claim 9, wherein the mobile pointers and the mobile dials are driven by the one or more primary shafts in combination with or independently of one or more secondary shafts of the clock mechanism.

13. The dial module according to claim 9, wherein the mobile pointers and the mobile dials are driven by one or more gears.

14. The dial module according to claim 13, wherein the one or more gears are provided with gearwheels that are structured on a maximum of two levels.

15. The dial module according to claim 1, wherein at least one of the dials is fixed with respect to the casing of the dial module or is integrated with the casing.

16. A clock, comprising:

the dial module according to claim 1.

17. The dial module according to claim 1, wherein the indication scale is a timescale.

* * * * *